US011284754B2

(12) United States Patent
Fang et al.

(10) Patent No.: US 11,284,754 B2
(45) Date of Patent: Mar. 29, 2022

(54) NON-SLIP TOILET TRAINING DEVICES

(71) Applicant: Munchkin, Inc., Van Nuys, CA (US)

(72) Inventors: Ruth Hsin-Ju Fang, Monterey Park, CA (US); Thomas E. Birkert, West Hills, CA (US); Shirley Rodriguez, Miami, FL (US)

(73) Assignee: Munchkin, Inc., Van Nuys, CA (US)

( * ) Notice: Subject to any disclaimer, the term of this patent is extended or adjusted under 35 U.S.C. 154(b) by 0 days.

(21) Appl. No.: 15/379,457

(22) Filed: Dec. 14, 2016

(65) Prior Publication Data

US 2017/0164796 A1 Jun. 15, 2017

Related U.S. Application Data

(60) Provisional application No. 62/267,167, filed on Dec. 14, 2015.

(51) Int. Cl.
*A47K 13/06* (2006.01)
*A47K 13/02* (2006.01)

(52) U.S. Cl.
CPC ..... *A47K 13/06* (2013.01); *A47K 13/02* (2013.01)

(58) Field of Classification Search
CPC ..... A47K 13/06
USPC ..... 4/239
See application file for complete search history.

(56) References Cited

U.S. PATENT DOCUMENTS

| | | | | |
|---|---|---|---|---|
| 2,266,641 | A * | 12/1941 | Maurice | A47K 13/06 4/235 |
| 3,601,822 | A | 8/1971 | Weiss | |
| 5,778,460 | A | 7/1998 | Doell et al. | |
| 6,339,851 | B1 | 1/2002 | Bergkvist | |
| 2007/0017015 | A1 | 1/2007 | Finell | |
| 2007/0101482 | A1 | 5/2007 | Dunn et al. | |
| 2008/0263756 | A1 | 10/2008 | Marsden | |
| 2014/0259338 | A1 | 9/2014 | Welch et al. | |

OTHER PUBLICATIONS

International Search Report and Written Opinion for PCT/US2016/066734, dated Mar. 22, 2017, 13 Pages.
European Search Report and Written Opinion for EP16876629.3-1005, dated Jul. 16, 2019 (pp. 8).

* cited by examiner

*Primary Examiner* — Christine J Skubinna
(74) *Attorney, Agent, or Firm* — Alan D. Borelli, Esq.; Robert Z. Evora, Esq.

(57) ABSTRACT

Non-slip toilet training devices are disclosed which include a layer of resilient material positioned at all contact surfaces between the training device and a conventional toilet. A raised resilient front portion serves to prevent potential urine flow from spraying outside of the confines of the training device.

16 Claims, 6 Drawing Sheets

NON-SLIP TOILET TRAINING DEVICES

CROSS REFERENCE TO RELATED APPLICATIONS

This application claims priority to U.S. Provisional Patent Application Ser. No. 62/267,167, filed Dec. 14, 2015; the content of which is hereby incorporated by reference herein in its entirety into this disclosure.

TECHNICAL FIELD

The subject disclosure relates generally to the field of children's training devices. In particular, the subject disclosure relates to non-slip toilet training devices for children.

BACKGROUND

Conventional toilet training devices aim to teach toddlers how to effectively use a modern Western-style toilet seat. However, these training devices have had a number of deficiencies, including, but not limited to, insecure attachment to conventional toilets seats, unreliable stability while on a conventional toilet seat, and rough surfaces which can chafe or otherwise harm children. Many such conventional toilet training devices are simply a smaller toilet seat that sits atop a conventional "adult" toilet seat. Such smaller seats are unstable and unsafe for a toddler to use because they are prone to movement during use. A toddler may easily slip off the smaller training device seat and injure himself. The lack of stability of the small training seat resting upon the larger conventional seat can be unsettling to a toddler who does not feel relaxed enough to use the bathroom when he must also maintain balance to prevent a fall. Other than friction between the toddler's thigh or rear and the training seat, there is no other way of ensuring that the toddler will remain atop the seat. These instabilities and uncertainties serve to be counter-productive while teaching a toddler to gain confidence in using a standard toilet. Therefore, these deficiencies continue to be drawbacks in conventional toilet training devices.

SUMMARY OF THE SUBJECT DISCLOSURE

The present subject disclosure provides novel training devices which serve to boost the confidence of a toddle in training by providing a stable platform on the toddler to sit. Handles on each side of the seat are ergonomically positioned to allow the toddler to hold on to the training device. The device itself securely connects with a standard Western toilet through a number of attachment mechanisms. A set of bottom projections serve to secure the training device on to the center hole of the standard toilet, and a layer of resilient material coating the contact points of the training device serve to create a high friction surface to prevent further movement of the training device on the standard toilet.

In one exemplary embodiment, the present subject matter is a toilet training device. The device includes a substantially circular seat portion having a top surface, a bottom surface, a front portion, a back portion, and a pair of side portions; and a flexible, raised portion extending from the top surface and positioned in the front portion that resiliently flexes flat with downward pressure by a toddler.

In another exemplary embodiment, the present subject matter is a toilet training device. The device includes a substantially circular seat portion; a flexible, raised portion comprised of a resilient material and extending from a front portion that flexes flat with downward pressure by a toddler; and a pair of handles extending from the seat portion.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Particular embodiments of the present subject disclosure will now be described in greater detail with reference to the figures.

Figure 1:
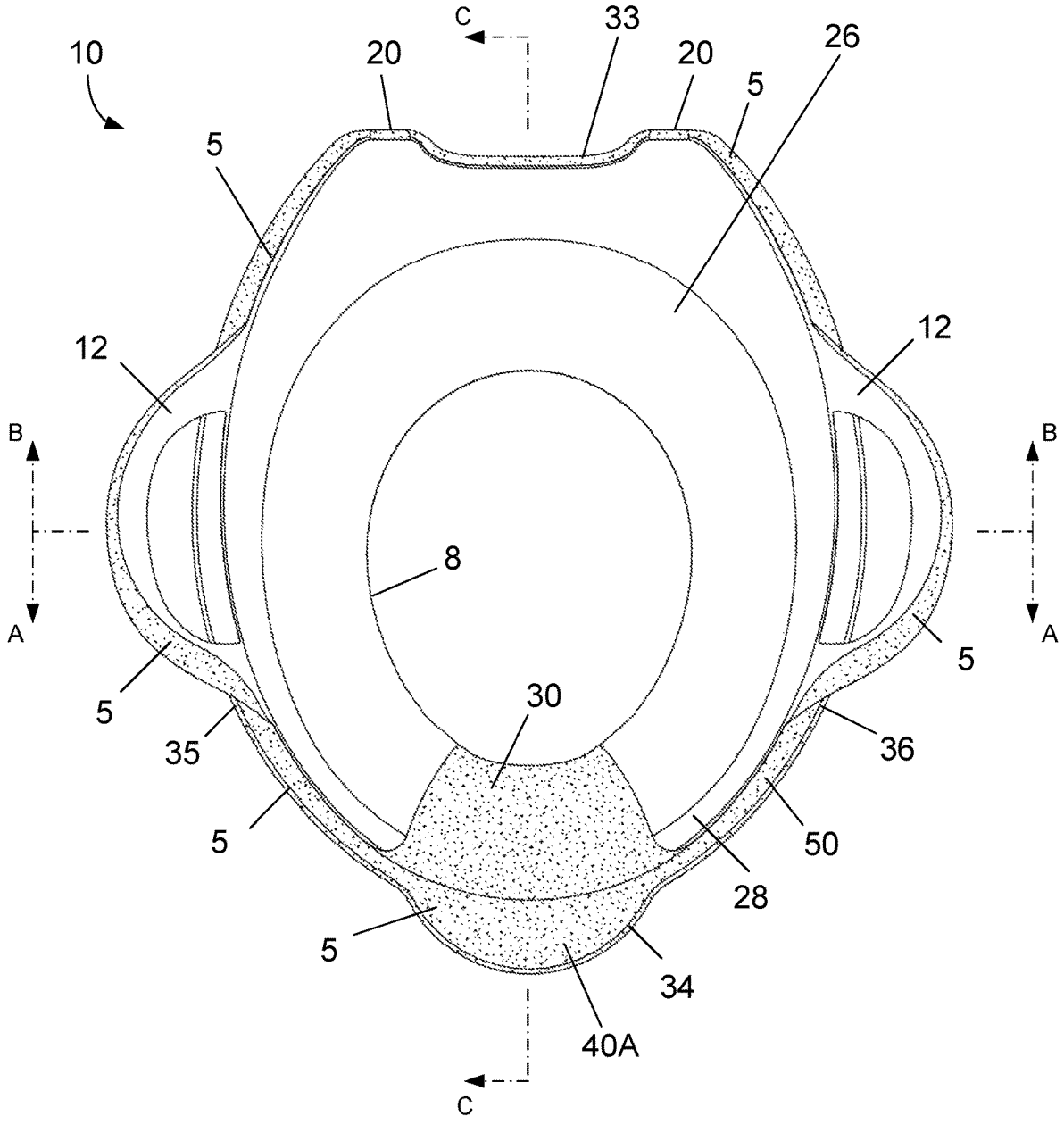
FIG. 1 illustrates a top view of a toilet training device, according to an exemplary embodiment of the present subject disclosure.
Figure 2:
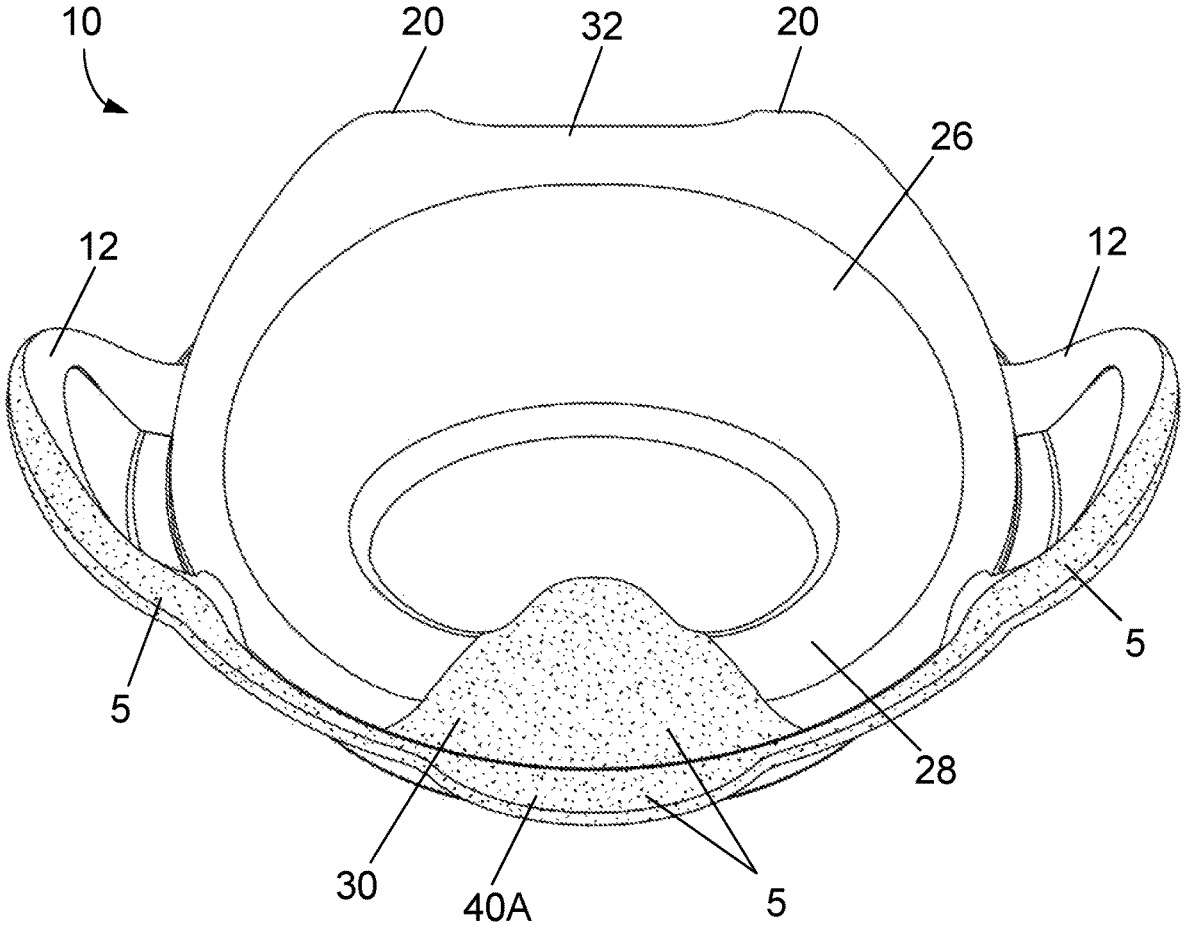
FIG. 2 shows a top perspective view of the toilet training device, according to an exemplary embodiment of the present subject disclosure.
Figure 3:
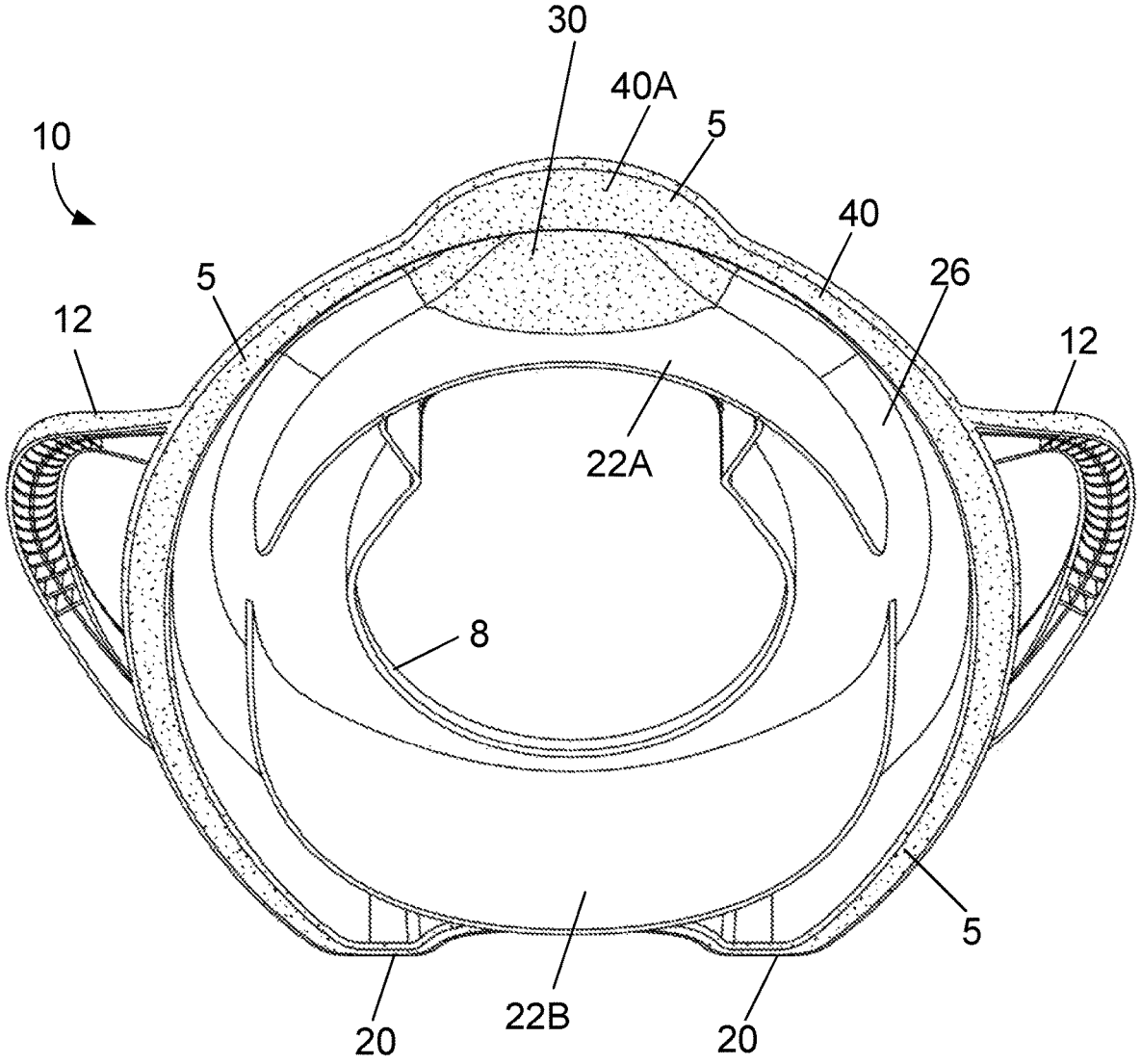
FIG. 3 depicts a lower perspective view of the toilet training device, according to an exemplary embodiment of the present subject disclosure.
Figure 4:
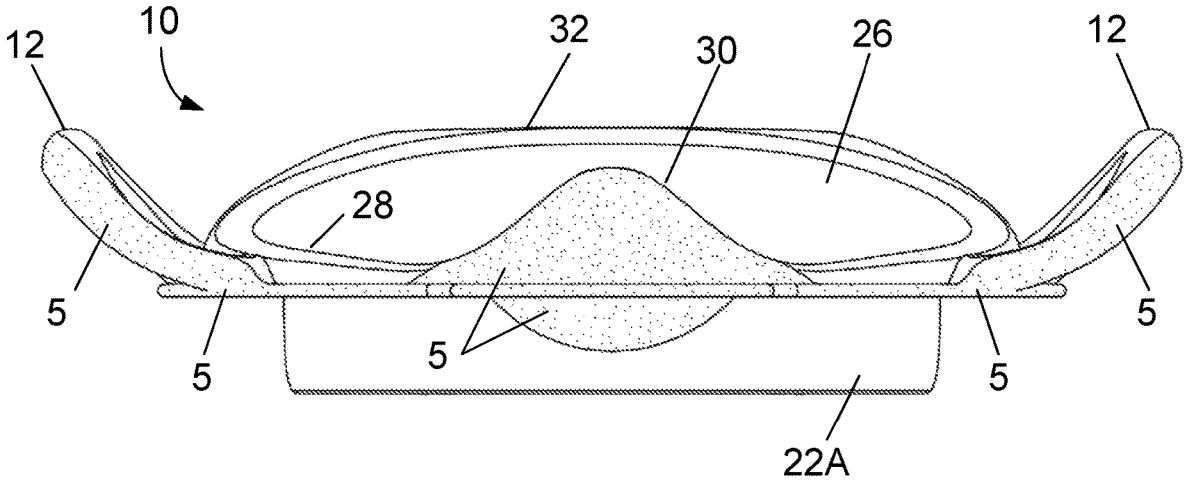
FIG. 4 illustrates a front view of the toilet training device, according to an exemplary embodiment of the present subject disclosure.
Figure 5:
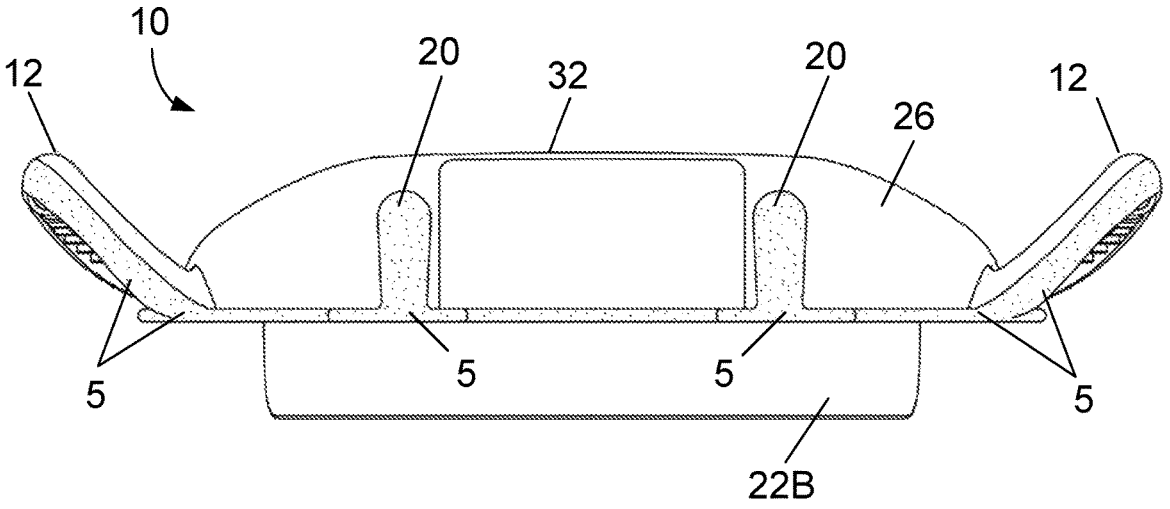
FIG. 5 shows a rear view of the toilet training device, according to an exemplary embodiment of the present subject disclosure.
Figure 6:
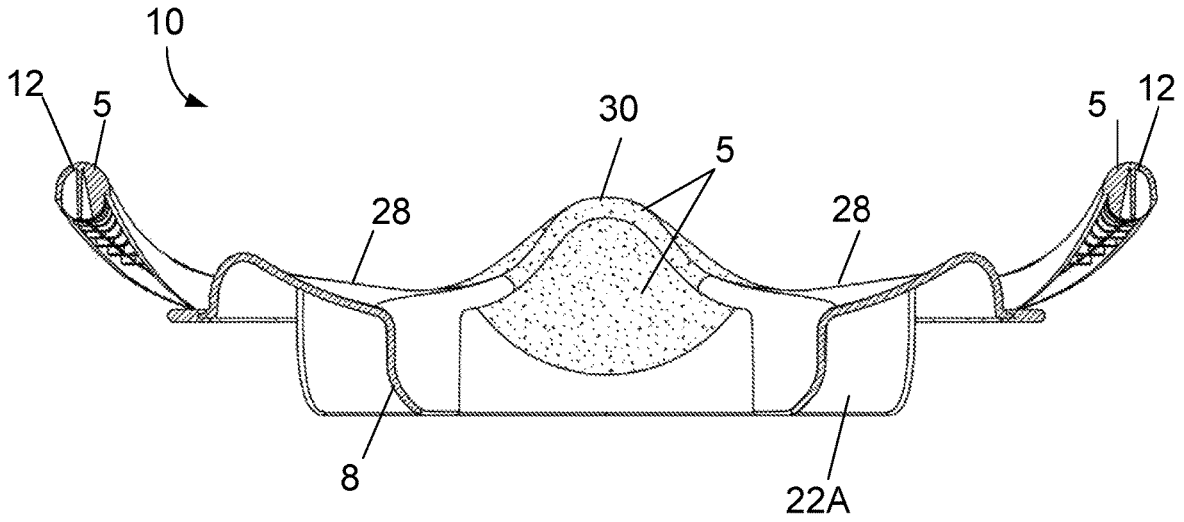
FIG. 6 depicts a cross section view of the toilet training device about cross section line A-A in FIG. 1, according to an exemplary embodiment of the present subject disclosure.
Figure 7:
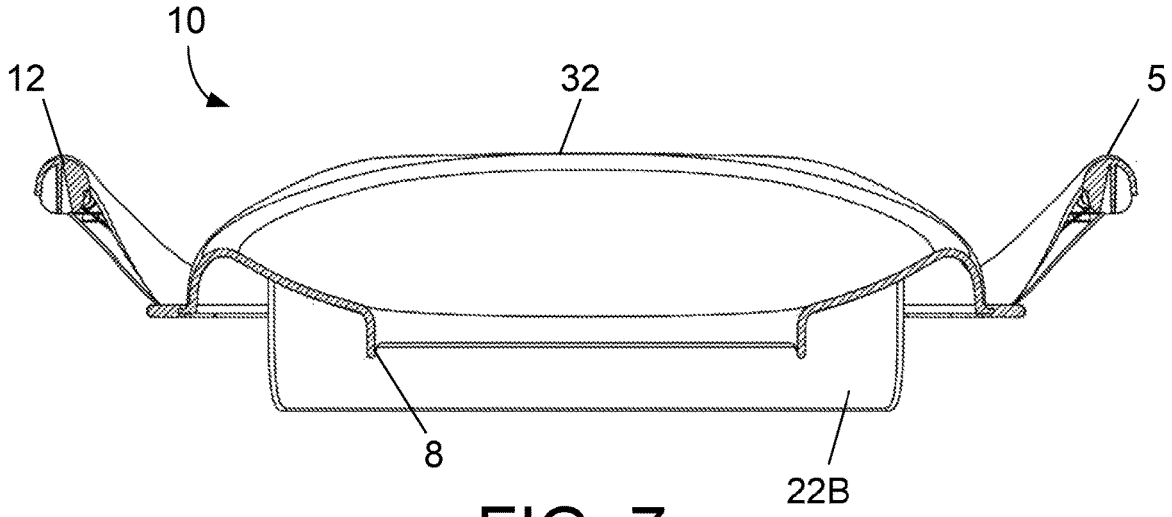
FIG. 7 illustrates a cross section view of the toilet training device about cross section line B-B in FIG. 1, according to an exemplary embodiment of the present subject disclosure.

FIGS. 1-3 show a top, upper perspective and lower perspective views, respectively, of an exemplary toilet training device 10 in accordance with the present subject disclosure. Children may use toilet training device 10 in order to assist them in learning how to use bathroom facilities like an adult. Toilet training device 10 is designed to be placed over top of an existing conventional Western toilet seat in order to permit a child to become familiar with and use an adult toilet.

The toilet training device 10 includes a substantially circular shape with a width thick enough to comfortably support the buttocks of a young toddler. The toilet training device 10 has a seat portion 26 having an internal opening 8. The toilet training device 10 has a pair of handles 12, each handle 12 attached to a first side 35 and a second side 36 of the seat portion 26. A pair of stand members 20 is provided on a rear portion 33 of the toilet training device 10. A first seat positioner 22A and a second seat positioner 22B are provided on a bottom side of the seat portion 26. The toilet training device 10 is configured to have a raised rear portion 32 and a lower front portion 28. The toilet training device 10 has a flexible raised front portion 30, at the front portion 34 of the toilet training device 10 rising up from the lower front portion 28 of the seat portion 26, that acts as a urine guard.

As shown in dotted shaded texture line work, a resilient non-slip flexible material 5 is provided at various locations along the toilet training device 10 to increase the comfort and grip-ability of the toilet training device 10 to a toilet seat while in use. Unlike conventional toilet training devices that are made of a substantially hard plastic, and which make it substantially more difficult for a toddler to position and sit on top of the over the toilet training seat, the present subject disclosure provides flexible material at various locations on the toilet training device 10 which serve to increase grip-ability of the training seat with respect to the conventional toilet seat, but also decrease any potential harm to the toddler user.

The resilient flexible material 5 may be co-molded onto the toilet training device 10 and/or provided in any suitable manner according to this subject disclosure. The resilient flexible material 5 constituting the subject disclosure may include various non-slip materials, including but not limited to, a rubber material, silicon rubber, or the like, and might comprise, for example, a gripping flexible plastic, an adhesive, neoprene, vinyl, a TPE, and/or any other suitable non-slip material according to this subject disclosure. The resilient non-slip flexible material 5 may be constructed from any suitable non-slip material designed not to scrape, or wear away by friction or erosion, or otherwise damage the surface of the toilet bowl caused by constant contact with the toilet training device 10. The resilient non-slip flexible material 5 is rinsable and washable so as to be easily kept in a sanitary condition, as well as being durable to withstand heavy use.

Various other parts of the toilet training device 10 may be made from a plastic material, such as polypropylene, an ABS copolymer, a resin, nylon, a soft thermoplastic or other substantially rigid material to withstand the weight of the toddler and to provide sufficient durability to withstand being thrown, dropped, chipped and exposed to other harsh environments that the toilet training device 10 may be subjected to during everyday use from a toddler. Likewise, the toilet training device 10 may be constructed to have a smooth surface that further reduces the number of potential areas in which grime or bacteria can grow. The smooth surface also allows for more ease in rinsing or cleaning the surface as needed.

The flexible raised front portion 30 at the front portion 34 of the toilet training device 10 may be composed partially, substantially or completely of the resilient non-slip material 5. As the toddler or small child climbs onto the toilet training device 10, the raised front portion 30 flexes or bends downward out of the way of the toddler climbing onto the toilet training device 10. That is, the raised front portion 30 can be compressed downward to reduce the raised front portion 30 to a flat configuration as the child positions himself over the toilet training device 10. Once the toddler is in position, the raised front portion 30 is biased to rebound back into the upward raised (uncompressed) position to act as a urine guard during use. The raised front portion 30 serves to capture and deflect downward most of the urine which may be sprayed onto the front portion of the toilet training device 10 while an infant is urinating. This is particularly useful for boy toddlers who may not have control of direction of urine flow. Temporarily removing the raised front portion 30 as the child positions himself on top of the toilet training device adds to the encouragement process of toilet training the child in a less cumbersome manner.

As shown in FIGS. 1-4 and 6, the resilient non-slip material 5 makes up substantially the entire raised front portion 30 on the seat portion 26. The resilient non-slip material 5 may be bonded to the various places in the toilet training device in a variety of different methods, such as by sonic welding, co-molding, over-molding, utilizing an adhesive and/or any other suitable method for fastening according to this subject disclosure.

The resilient non-slip material 5 is shown provided at various locations. It is to be understood that the resilient non-slip material 5 may be placed anywhere on the toilet training device 10. Likewise, the resilient non-slip material 5 may be provided to replace various entire sections or parts of the toilet training device 10. The resilient non-slip material 5 is shown disposed onto at least the following parts: the handle 12, the lower rim 40, the raised front portion 30, the stands 20, and the like.

The first and second handles 12 that are located on a first side 35 and a second side 36, respectively, of seat portion 26 provide the child being toilet trained with a feeling of stability and security when sitting on the toilet training device 10 that will mitigate to some extent the feeling of insecurity that small children may tend to feel because their feet do not touch the floor when sitting on a toilet.

The handles 12 are preferably located substantially symmetrically across the seat portion 26 from each other at approximately where a toddler would reach straight down from the side of her torso. The handles 12 may be fixed or retractable, such as described in U.S. Pat. No. 7,631,370, which disclosure is incorporated by reference herein in its entirety into this disclosure.

The stand members 20 are utilized in order to store the toilet training device 10 in a vertical upright position either on the floor of a bathroom or upon some other horizontal surface. When stored vertically, the toilet training device 10 may rest upon the stand members 20. Vertically storing toilet training device 10 will permit the device to have a small footprint and be stored in a space efficient manner, while still remaining readily accessible by a child or parent. In one exemplary embodiment, two stand members 20 are used to enable vertical stand storage, however this number could be increased or decreased so long as the stand members 20 prove effective in supporting device 10 in a stable manner.

Figure 8:
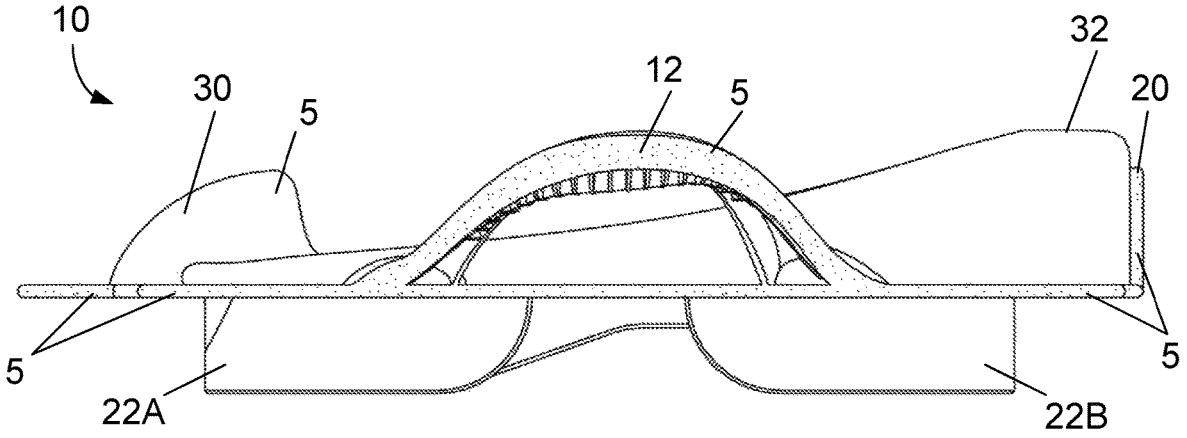
FIG. 8 shows a side view of the toilet training device, according to an exemplary embodiment of the present subject disclosure.
Figure 9:
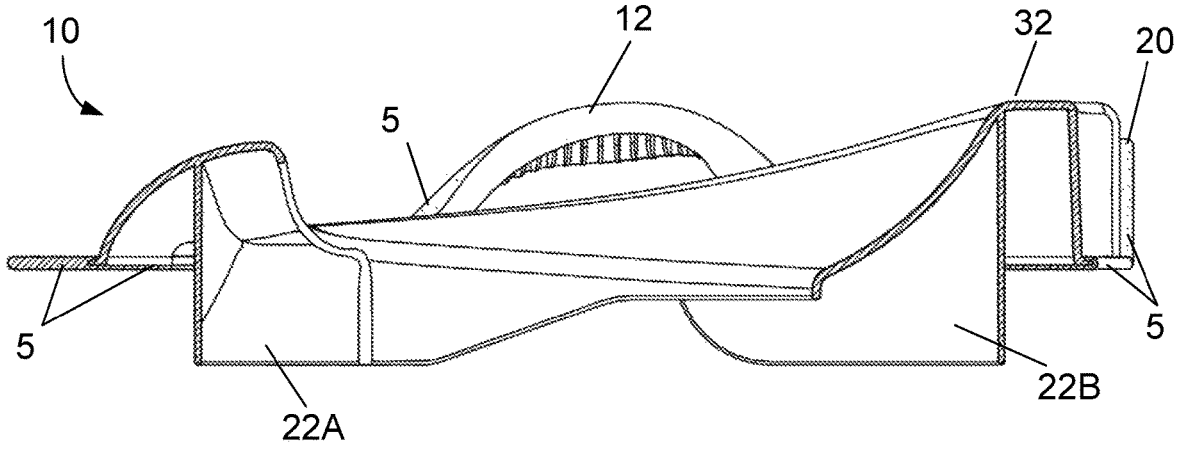
FIG. 9 depicts a cross section view of the toilet training device about cross section line C-C in FIG. 1, according to an exemplary embodiment of the present subject disclosure.

FIGS. 1 and 8-9 show the stand members 20 as viewed from the top and the side. The stand members 20 each have a flat surface that is preferably dimensionally large enough to span a grouting crack in a conventional tiled floor. The rear portion 33 of the toilet training device 10 may be arched to provide more stabilization for the stand members 20 when the toilet training device 10 is stored on a surface that is not entirely level, or that may be textured in such a manner so as to prevent an entirely flat stand member from resting properly.

FIGS. 3-9 present various views which show portions of the lower end of the seat member 26. A lower rim 40 substantially encircles the lower end of the toilet training device 10 and is enlarged in various locations, such as in the extended tongue-like front 40A rim portion, to increase the surface area contact the toilet training device 10 will make with the seat of the toilet to increase its non-slip capabilities. The lower rim 40 includes a layer of the non-slip flexible material 5 along the lower rim 40 surface. In this manner, the toilet training device 10 will cause a more secure friction fit between the lower rim 40 and the toilet seat upon which the toilet training device 10 is disposed.

As shown in FIGS. 3-9, the first seat positioner 22A and the second seat positioner 22B are attached to the seat member 26. As shown, the seat positioners 22 may be semi-circular in shape and located proximate the opening 8 in the seat member 26. The seat positioners 22A, 22B extend downwards. The seat positioners 22 are designed to fit and be secured within an opening of a conventional toilet seat. The shape of seat positioners 22 can accommodate any variety of toilet seat openings and permit secure placement of the device. Usage of the two semi-circular shaped seat positioners 22 enables safe securing of the device while keeping the overall cost of material used in the construction to a minimum. Seat positioner 22 may also be constructed to form one complete oval or circle, or alternatively, broken into smaller arcs.

The toilet training device 10 may be integrated with a cushion provided upon the seat portion 26. The cushion may be filled with foam material in order to provide a comfortable seat for children when using training device 10.

The toilet training device 10 may include various indicia, such as various character designs, logos, or any other design characteristics.

The illustrations and examples provided herein are for explanatory purposes and are not intended to limit the scope of the appended claims. It will be recognized by those skilled in the art that changes or modifications may be made to the above described embodiment without departing from the broad inventive concepts of the subject disclosure. It is understood therefore that the subject disclosure is not limited to the particular embodiment which is described, but is intended to cover all modifications and changes within the scope and spirit of the subject disclosure.

What is claimed is:

1. A toilet training device comprising:

a substantially circular seat portion having a top surface, a bottom surface, a front portion, a back portion, and a pair of side portions;

a flexible, raised portion comprised of a resilient material that is contiguous with and substantially flush from the top surface and positioned in the front portion that resiliently flexes flat in a flat position with downward pressure by a toddler; and at least one semi-circular seat positioner projecting downward from the bottom surface, the semi-circular seat positioner having an exterior curved surface that is contoured to abut against the inner circumference of a toilet seat, and an interior curved surface that opens towards a center of a toilet bowl when installed, wherein the resilient material of the raised portion extends into and is integrated with the seat positioner, the resilient material compressing downward into the seat positioner with pressure and thereby maintaining a smooth top surface in the flat position.

2. The toilet training device of claim 1, wherein the back portion is positioned higher than the front portion.

3. The toilet training device of claim 1, further comprising a handle extending from each of the pair of side portions.

4. The toilet training device of claim 3, wherein each handle is comprised of a resilient material.

5. The toilet training device of claim 1, further comprising a stand member extending from the back portion to allow the training device to stand vertically on the back portion when not in use.

6. The toilet training device of claim 5, wherein the stand member comprises a pair of elongated flat surfaces.

7. The toilet training device of claim 1, further comprising a lower rim positioned on the bottom surface which substantially encircles the bottom surface of the training device.

8. The toilet training device of claim 7, wherein the lower rim is covered by a layer of resilient material to promote traction between the toilet training device and a toilet on which the toilet training device is positioned.

9. The toilet training device of claim 7, wherein the lower rim includes a front projection which extends beyond the raised portion to promote traction between the toilet training device and a toilet on which the toilet training device is positioned.

10. The toilet training device of claim 1, further comprising a plurality of seat positioners positioned on the bottom surface which extend from the bottom portion of the training device.

11. The toilet training device of claim 10, wherein the plurality of seat positioners comprises a pair of semi-circular projections with concave surfaces facing each other and adapted to secure within the toilet seat.

12. A toilet training device comprising:

a substantially circular seat portion;

a flexible, raised portion comprised of a resilient material fixedly attached to and extending substantially flush from a front portion that flexes flat in a flat position with downward pressure by a toddler;

at least one semi-circular seat positioner projecting downward from a bottom surface of the seat portion, the semi-circular seat positioner having an exterior curved surface that is contoured to abut against the inner circumference of a toilet seat, and an interior curved surface that opens towards a center of a toilet bowl when installed; and a pair of handles extending from the seat portion, wherein the resilient material of the raised portion extends into and is integrated with the seat positioner, the resilient material compressing downward into the seat positioner thereby maintaining a smooth top surface in the flat position.

13. The toilet training device of claim 12, further comprising a lower rim positioned on a bottom surface of the seat portion which substantially encircles a bottom portion of the seat portion.

14. The toilet training device of claim 13, wherein the lower rim is covered by a layer of the resilient material to promote traction between the toilet training device and a toilet on which the toilet training device is positioned.

15. The toilet training device of claim 13, wherein the lower rim includes a front projection which extends beyond the raised portion to promote traction between the toilet training device and a toilet on which the toilet training device is positioned.

16. The toilet training device of claim 12, further comprising a plurality of seat positioners which extend from a bottom portion of the seat portion and adapted to secure within the toilet seat.

* * * * *